United States Patent [19]

Niimi et al.

[11] Patent Number: 4,561,152

[45] Date of Patent: Dec. 31, 1985

[54] DRAFT ROLL SYSTEM FOR SPINNING MACHINES

[75] Inventors: Kiwamu Niimi, Toyoake; Kenji Kinoshita, Tokai, both of Japan

[73] Assignee: Kabushiki Kaisha Toyoda Jidoshokki Seisakusho, Karyia, Japan

[21] Appl. No.: 572,664

[22] Filed: Jan. 20, 1984

[30] Foreign Application Priority Data

Feb. 8, 1983 [JP] Japan ..... 58-19472
Feb. 8, 1983 [JP] Japan ..... 58-154606

[51] Int. Cl.[4] ..... D01H 5/86

[52] U.S. Cl. ..... 19/244; 19/293; 19/236

[58] Field of Search ..... 19/244, 236, 237, 248, 19/252, 253, 258, 260, 293

[56] References Cited

U.S. PATENT DOCUMENTS

| | | | |
|---|---|---|---|
| 2,686,940 | 8/1954 | Burnham | 19/236 |
| 3,869,759 | 3/1975 | Savageau et al. | 19/293 |
| 4,195,389 | 4/1980 | Schulz et al. | 19/293 |
| 4,314,388 | 2/1982 | Hartmannsgruber et al. | 19/293 |
| 4,398,320 | 8/1983 | Kubota et al. | 19/236 |

FOREIGN PATENT DOCUMENTS

| | | | |
|---|---|---|---|
| 0074932 | 3/1983 | European Pat. Off. | 19/293 |
| 2062712 | 5/1981 | United Kingdom | 19/236 |

*Primary Examiner*—Louis K. Rimrodt
*Assistant Examiner*—J. L. K. Olds
*Attorney, Agent, or Firm*—Brooks Haidt Haffner & Delahunty

[57] ABSTRACT

The present invention provides a draft roll arrangement in a spinning frame in which the apron bottom roll is longitudinally divided into two sections at a location along its length selected to be within a range for which torsion of the apron bottom roll does not pose a problem in spinning, and in which the respective bottom rolls are operatively connected to one another in such a manner that one of the ends of the back and front bottom rolls and one apron bottom roll section are connected to a driving source and the drive for the other apron bottom roll section is derived through the back and front bottom rolls. In a preferred embodiment, the respective apron bottom roll sections are associated with rotational angle sensors whose output rotational angle signals are supplied to a control unit. When the difference in the rotational angle has exceeded a preset value, an output signal indicating such state is issued from the control unit.

7 Claims, 4 Drawing Figures

DRAFT ROLL SYSTEM FOR SPINNING MACHINES

BACKGROUND OF THE INVENTION

This invention relates to a draft roll system for a flyer frame, spinning frame or the like in which the main draft is imparted to a sliver or a roving after imparting a preliminary draft by a plurality of draft rolls rotating at different speeds.

In a spinning machine in general and especially a spinning frame, as shown in FIGS. 1 and 2, a preliminary draft is imparted to a roving R by passing the roving through a nip between a back bottom roll 1 and a back top roll 1' kept in pressure contact with each other, and through a nip between a "mid bottom" roll 2 and a "mid top" roll 2 kept in pressure contact with each other and rotating at a faster speed than the set of back rolls 1, 1'. The main draft is then imparted to the roving by passing it through a nip between a front bottom roll 3 and a front top roll 3' also kept in pressure contact with each other and rotating at a faster speed than the set of "mid rolls" 2, 2'. Finally, the roving is drawn out from the nip between the front rolls 3, 3' and twisted into yarn, which is then taken up on a bobbin (not shown) fitted onto a spindle 7. The spindle 7 is rotated responsive to rotation of the drive shaft 4 which is connected to an electric drive motor (not shown) through a pulley 5 mounted on shaft 4 and a driving bolt 6.

Heretofore, the driving force for the bottom rolls 1, 2, 3 was derived from the drive shaft 4 through a gearing unit connected to one of the ends of each of the rolls as shown in FIG. 1, the other ends of the bottom rolls 1, 2, 3 being supported to rotate freely. However, in a spinning machine having a large number of spindles, the bottom rolls 1, 2, 3 tend to have increased length. Thus upon start-up the spinning machine, rotation of the bottom rolls 1, 2, 3 at their freely supported other end is delayed through torsion occurring at said other ends, that is, rotation of the bottom rolls at the one of their ends is not synchronized with rotation of the rolls at their outer ends. The spun yarn obtained by the draft roll system suffering from this phenomenon is not uniform in quality and problems may be caused, such as yarn breakage or unevenness.

Such torsion on the bottom rolls 1, 2, 3 is also caused by a larger rotational resistance offered by these rolls. The pair of aprons 8, 8' provided on the "mid-bottom" roll 2 and "mid-top" roll 2' for improving drafting conditions as shown in FIG. 2 tends to increase the rotational resistance of "mid-bottom" roll 2 (hereafter called apron bottom rolls). The result is that a larger load is placed on the apron bottom roll 2, thus frequently causing roll breakage.

In an attempt to remove such deficiency, it has also been known to provide a gearing similar to the gearing shown in FIG. 1 on the free ends of the bottom rolls 1, 2, 3 for reducing torsion on the bottom rolls 1, 2, 3. However, in such case, when the speed ratio between the respective bottom rolls is changed with changes in drafting conditions, it becomes necessary to change the speed change gears in both of the gearing units. Should an error be caused in the gear changing operation such that the rotational speed is not coincident at both ends of the bottom rolls, severe accidents may be caused such as breakage of the bottom rolls of destruction of the gearing units.

In the case where the lengths of the bottom rolls 1, 2, 3 are increased with an increase in the number of spindles in the spinning frame or unit, it may also be envisioned to use bottom rolls 1, 2, 3 of a larger diameter to increase their strengths for thereby preventing the torsion and the resulting risk of roll breakage. However, because of limitations upon the fiber length in the roving or silver, it is not possible to increase the distance between the respective bottom rolls 1, 2, 3, which are necessarily placed close to one another. Especially, a larger gage of spacing between the back bottom roll 1 and the apron bottom roll 2 results in the formation of stray fibers, thus again causing yarn unevenness. For these reasons, it is not possible to simply increase the diameter of the bottom rolls responsive to an increase in the number of spindles in the spinning unit.

It should also be noted that the apron 8 wound about the apron bottom roll 2 tends to become worn out or contaminated and hence needs to be replaced or cleaned frequently. The operation of mounting and demounting the apron 8 for such exchange or cleaning would be highly troublesome if the apron bottom roll 2 were to be elongated to cope with an increase in the number of the spindles in the spinning unit.

Hence, there exists a demand for a draft roll driving device, whereby torsion on the bottom rolls used in a spinning machine comprised of a number of spindles may be reduced without increasing the diameters of the bottom rolls and whereby the number of spindles in the spinning machine may be increased without experiencing yarn unevenness or breakage.

SUMMARY OF THE INVENTION

The present invention provides an arrangement in which the apron bottom roll is longitudinally divided into two sections at a location along its lengths which is selected to be within a range for which torsion of the apron bottom roll does not pose a problem in spinning, and in which the respective bottom rolls are operatively connected to one another in such a manner that one of the ends of the back and front bottom rolls and one apron bottom roll section are connected to a driving source, and the drive for the other apron bottom roll section is derived through the back and front bottom rolls.

According to a preferred embodiment, the respective apron bottom roll sections are associated with rotational angle sensors whose output rotational angle signals are supplied to a control unit. When the difference in the rotational angle has exceeded a preset value, an output signal indicating such state is issued from the control unit. The output signal may be used effectively for preventing the risk of front bottom roll breakage.

DESCRIPTION OF THE PREFERRED EMBODIMENT

Figure 1:
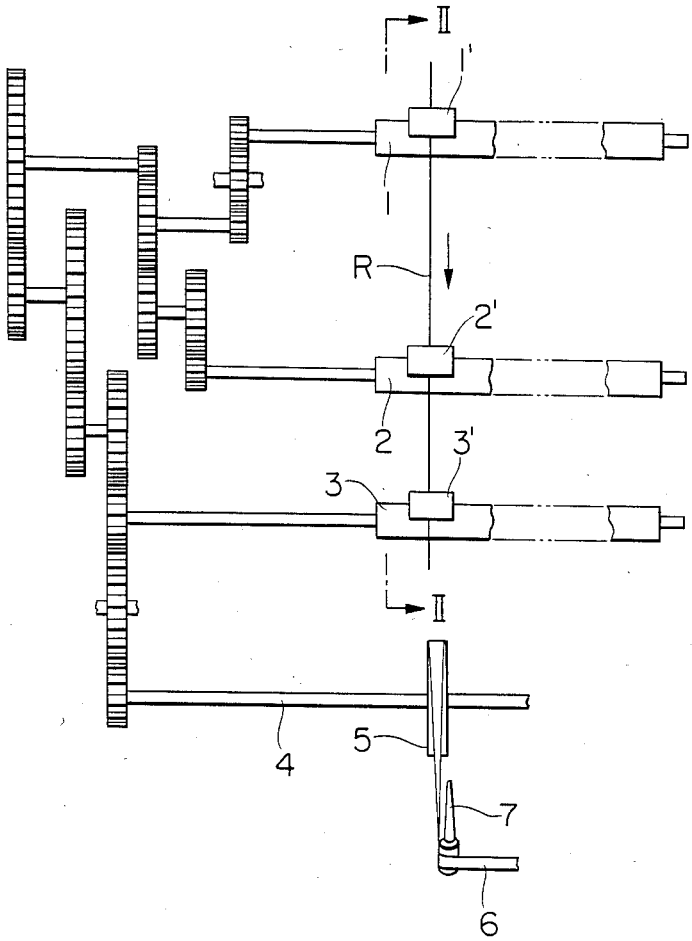
FIG. 1 PRIOR ART
FIG. 1 is a diagrammatic plan view showing a part of the conventional draft roll system.
Figure 2:
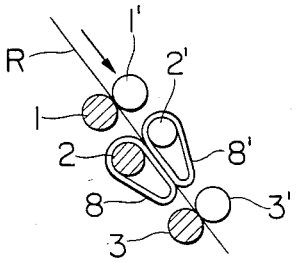
FIG. 2 PRIOR ART
FIG. 2 is a sectional view taken along line II—II of FIG. 1.
Figure 3:
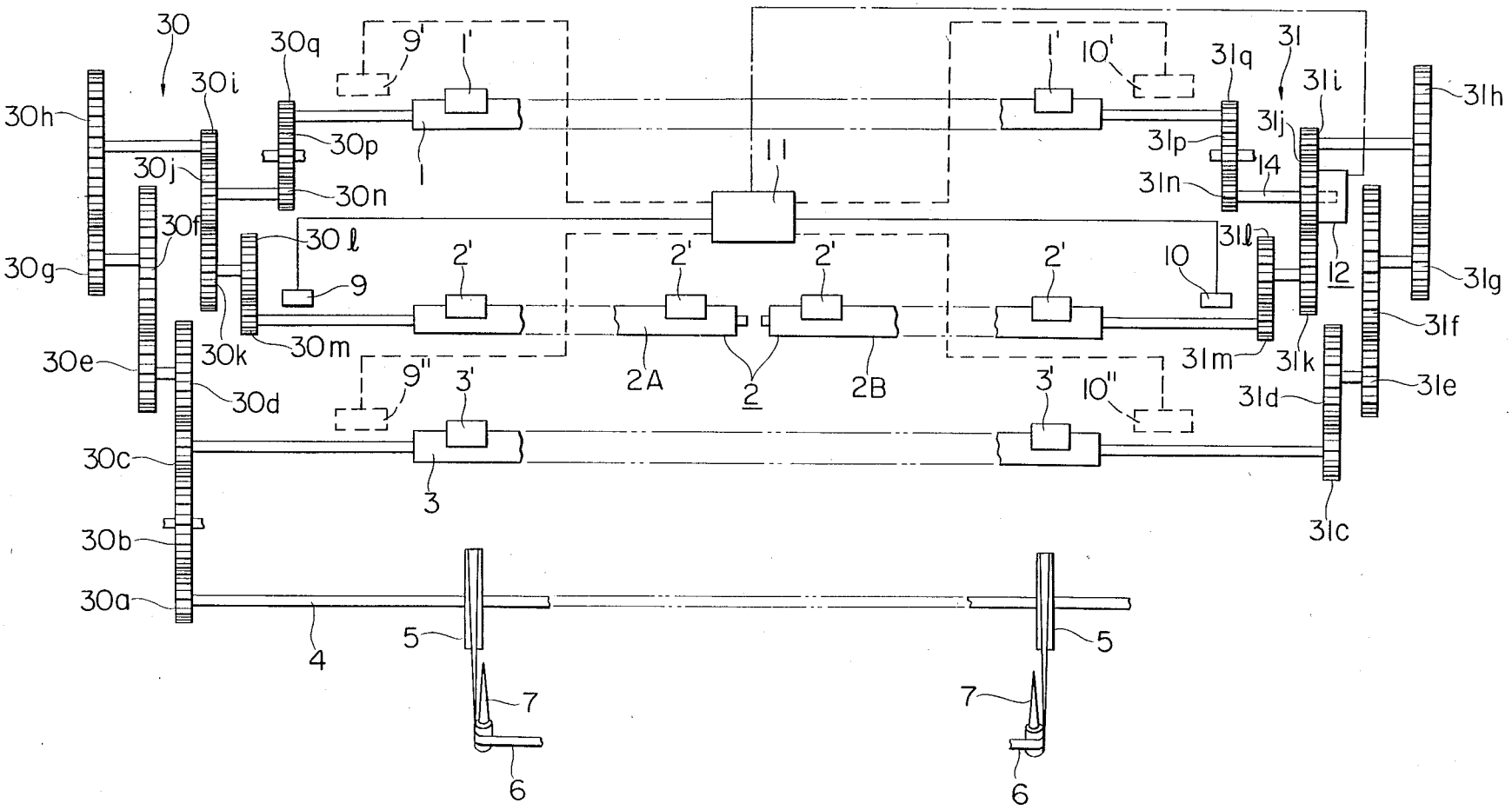
FIG. 3 is a diagrammatic plan view showing a draft roll system incorporating a draft roll driving device according to an embodiment of the present invention.

A preferred embodiment of the present invention is now described by referring to FIG. 3, in which the parts similar to those of the aforementioned conventional device are depicted by the same numerals and the detailed description thereof is omitted for simplicity.

The apron bottom roll 2 is divided centrally longitudinally into a first apron bottom roll section 2A and a separate but axially aligned second apron bottom roll section 2B, mounted for independent rotation. The rotational force of the drive shaft 4 is transmitted to the front bottom roll 3, first apron bottom roll section 2A and the back bottom roll 1 through a first gearing unit 30 interconnecting the same side ends (left side ends in FIG. 3) of the respective bottom rolls 1, 2, 3. The gearing unit 30 is comprised of gears 30*a* to 30*n* and 30*p*, 30*q* meshing with one another as shown. The rotational force transmitted to the front and back bottom rolls 3, 1 is transmitted to second apron bottom roll section 2B through a second gearing unit 31 comprised of gears 31*c* to 31*n* and 31*p*, 31*q* that are arranged symmetrically relative to the gears 30*c* to 30*n* and 30*p*, 30*q* of the gearing unit 30 and that are designed for operatively connecting the opposite side ends (right side ends in FIG. 3). In this manner, the driving force for the second apron bottom roll portion 2B is derived from the front bottom roll 3 and the back bottom roll 1.

It should be noted that the gearing units 30, 31 are so designed that the speed ratio of any two of arbitrarily selected bottom rolls 1, 2 or 3 at one end is the same as that is the other roll end.

The first and second apron bottom roll sections 2A, 2B are operatively associated with magnetic or optical rotational angle sensors 9, 10 which may be of any type known in the art and which emit the same number of pulse signals per rotation of the first and second apron bottom roll sections 2A, 2B. The pulse signals issued by the sensors 9, 10 are transmitted to a control circuit 11 adapted to transmit operational commands to an electro-magnetic clutch unit 12, mounted on the second gearing unit 31 at the side of front bottom roll section 2B, when the difference between the numbers of the pulse signals has exceeded a preset value. The clutch unit 12 is designed for on/off switching of the driving path from the back bottom roll 1 to the second apron bottom roll protion 2B.

Figure 4:
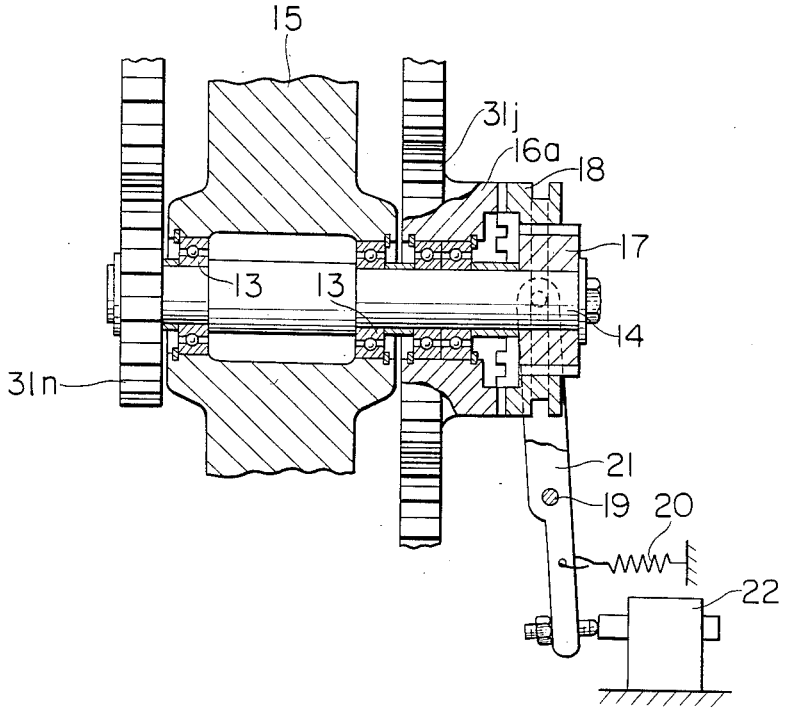
FIG. 4 is a cross sectional side view showing a clutch device included in the draft roll driving device shown in FIG. 3.

The clutch unit 12 is now described by referring to FIG. 4.

The gear 31*n* is securely mounted to one end of a clutch shaft 14 rotatably carried through a bearing 13 by a stationary member 15 such as the machine base frame. The gear 31*j* is rotatably mounted on the other end of shaft 14 and formed with an substantially cylindrical clutch 16*a*. The other end of clutch shaft 14 is made fast with a spline the outer periphery of which carries a toroidal-shaped clutch member 18 corresponding to the clutch 16*a* and slidable along clutch shaft 14. The clutch member 18 is normally kept in pressure contact with clutch 16*a* by a lever 21 biased to rotate counterclockwise about shaft 19 under the force of a tension spring 20. It should be noted that the clutch 16*a* may be engaged by clutch member 18, and that the member 18 is disengaged from the clutch 16*a* when the solenoid 22 is energized upon reception of operational commands from the control circuit 11, the lever 21 thus being rotated clockwise about shaft 19.

In operation, the driving force from drive shaft 4 is transmitted through the first gearing unit 30 to the same side ends of back bottom roll 1, apron bottom roll section 2A and front bottom roll 3 for driving them at respective specified speeds. The apron bottom roll 2 has been divided into a first section 2A and a second section 2B and the aligned ends therebetween are mechanically separated from each other and rotatably supported by means well-known in the art, not shown. Hence, rotation of the first roll section 2A is not transmitted therethrough to the second section 2B. On the other hand, rotation of the back bottom roll 1 is transmitted through gears 31*q*, 31*p*, 31*n*, 31*j*, 31*k*, 31*l* and 31*m* of the second gearing unit 31 in this order, whereas rotation of front bottom roll 3 is transmitted through gears 31*c*, 31*d*, 31*e*, 31*f*, 31*g* , 31*h*, 31*i*, 31*j*, 31*k*, 31*l* and 31*m* of the second gearing unit 31 in this order, thus causing the second apron bottom roll section 2B to rotate at the same speed as first apron bottom roll section 2A. The respective bottom rolls are driven in this manner for applying preliminary draft and main draft to the roving or sliver.

In general, the load to be applied to back or front bottom rolls is extremely small as compared to that applied to the apron bottom roll. Thus it may be contemplated to derive the driving force of the second apron bottom roll section 2B solely from the front bottom roll 3 or from the back bottom roll 1. However, in a spinning unit having a large number of spindles such that the lengths of the bottom rolls are each twice that of the conventional unit, a load applied to the second apron bottom roll section of the same magnitude as that experienced with the conventional system would be applied per se to the elongated rolls 1 or 3 , with the result that the torsion on the front or back bottom rolls would be enhanced intolerably thus affecting the yarn quality. According to the present invention, the driving force for the second apron bottom roll section 2B is derived from the front and back bottom rolls 3, 1 and the angular delay of the second apron bottom roll section 2B relative to the first apron bottom roll section 2A is drastically reduced as compared to the case wherein the driving force of the roll section 2B is derived solely from back bottom roll 1 or from front bottom roll 3. Hence, even for longer lengths of the respective bottom rolls, 1, 2, 3, the angular delay of the second apron bottom roll section 2B relative to first apron bottom roll section 2A may be maintained at a level on the same order of magnitude as that experienced with the conventional spinning machine on account of torsion of the bottom roll. In this manner, the number of spindles per spinning machine can be increased without the risk of yarn breakage or unevenness caused by bottom roll torsion and without using large diameter back and front bottom rolls 1, 3.

Yarn breakage is likely to occur especially when the operation of the spinning machine is started after transient dwell. Thus, when the rotating bottom rolls which are in subjected to torsion are brought to a halt, the rolls become somewhat untwisted. When the bottom rolls are started again in the untwisted state of the rolls, yarn breakage results because the time necessary to transmit the rotation to the other end of any bottom roller is different from the respective corresponding times necessary for the other bottom rollers, because of the differences between the actual numbers of rotations of the respective bottom rollers (that is, the "mid-bottom" roller is delayed in its starting rotation with respect to the front bottom roller, and the back bottom roller is driven only aftr some delay with respect to the "mid-bottom" roller.). In order to prevent yarn breakage, it is required that the afore-mentioned roll untwisting be reduced to a minimum and that, in restarting, the bottom rollers start to rotate with allowable delays, preferably at the same time. Conventionally, an electro-magnetic clutch type device operative to lock the bottom roller has been employed for preventing the bottom roll from untwisting. However, this system has drawbacks, not only in that power consumption is inevitably increased for torsion prevention because such torsion prevention needs to be continued the during dwell time of the spinning unit, but also because the rotational delay upon restarting is not removed. The present invention makes it possible to reduce yarn breakage upon restarting of the spinning machine without the need to use the afore-mentioned special means for preventing roll untwisting, because the bottom roll torsion and natural bottom roll twisting are rather small, and the bottom rollers are allowed upon restarting to start to rotate substantially at the same time.

It should be noted that the electro-magnetic clutch 12 of the present embodiment is intended for preventing bottom roll breakage and, hence, in a manner different from the aforementioned electro-magnetic clutch unit intended for preventing roll untwisting. The clutch 12 need not be activated when the operation of the spinning unit is stopped upon disconnecting the clutch 12.

It should be noted that, when changing the drafting state of the roving R or sliver depending upon either the kinds of fibers or the desired count of yarn, it is necessary, with the embodiment shown in FIG. 3, to change the change gears 30*g*,31*g* adapted to change the speed ratio between the back bottom roll 1 and the front bottom roll 3; the change gear 30*l* adapted to change the speed ratio between the back bottom roll 1 and the first apron bottom roll section 2A; and the change gear 31*l* adapted to change the speed ratio between the back bottom roll 1 and the second apron bottom roll section 2B. Assuming that, in such gear change operation, one has failed to exchange the change gears 30*g*, 31*g* properly and thus a difference has been caused between the back bottom roll/front bottom roll speed ratio at the side of the first gearing unit 30 and that at the side of the second gearing unit 31, there is caused a difference between the rotational speed of the first apron bottom roll section 2A and the second apron bottom roll section 2B. The result is that a difference is caused between the respective numbers of pulse signals issued by the rotatory angle sensors 9, 10. When the difference exceeds the aforementioned preset value, an operational command is issued from the control circuit 11 to the electro-magnetic solenoid 22, whereby the connection between the clutch 16*a* and the clutch member 18 is released. Hence, the operative connection between the back bottom roll 1 and the front bottom roll 3 at the second gearing unit 31 is released so that breakage of the back bottom roll 1 or the front bottom roll 3 is prevented. The aforementioned preset value is naturally selected so that torsion of the bottom rolls 1, 3 may be confined within acceptable limits.

According to the present invention, an additional advantage may be derived from dividing the apron bottom roll into two sections. Thus, only one load disconnecting means such as electro-magnetic clutch means for releasing the operative connection between the bottom rolls 1, 2, 3 need be provided in order to successfully deal with occurrence of speed change gear exchange errors.

It should be noted that the present invention is not limited to the foregoing embodiment. For instance, it is also possible to provide another electro-magnetic clutch symmetrically at the side of the first gearing unit 30, or to stop the operation of the spinning unit at the same time that the electro-magnetic clutch 12 is disconnected. This is also effective to solve the problem of yarn unevenness or breakage caused by a change error when changing the change gears 30*l*, 31*l*. The electro-magnetic clutch 12 may be mounted at any desired place within the operative gear connections between the back bottom roll 1 and the front bottom roll 3, and may be any other type clutch than the one described in the present embodiment. The control circuit may be provided with a function of lighting an alarm lamp or buzzing a buzzer prior to supplying the operational command to the electro-magnetic clutch means 12. The present invention may also be embodied in a draft roll system in which a pair of apron bottom rolls are provided between the back bottom roll 1 and the front bottom roll 3. The gearing units 30, 31 may be replacd by a timing pulley, timing belt or chain. Furthermore, the positions at which the rotational angle sensors are provided, are not limited to those near the apron bottom roller sections 2A and 2B. They may be arranged near the opposite ends of the back bottom roll 1 as indicated by dotted lines and reference numerals 9', 10' in FIG. 3, or adjacent to the opposite ends of the front bottom roll 3 as indicated by dotted lines and reference numerals 9'', 10'' in FIG. 3, or may be incorporated in the gearing units 30 and 31, respectively (not illustrated).

From the foregoing it will be apparent that the present invention provides for longitudinally dividing the apron bottom roll into two sections, connecting the same side ends of the respective bottom rolls to a driving source and deriving the driving force for the apron bottom roll section at the other end of the system from the back and front bottom rolls, so that bottom roll torsion and consequent yarn unevenness or breakage may be prevented even with the spinning unit having an increased number of spindles, and the number of spindles may be increased without the need for enlarging the diameters of the bottom rolls. According to a preferred embodiment of the present invention, rotational angle sensors are provided on both sections of the apron bottom roll, and a control device is provided for issuing signals for stopping the operation of the spinning machine or releasing the operational connection when the difference in the phase of rotation as sensed by these two sensors has exceeded a preset value. Hence the risk of bottom roll breakage may be prevented even if an operational error has been caused in changing the speed ratio between the back bottom roll and the front bottom roll responsive to changes in the drafting state of the roving or sliver depending on the kinds of fibers or the desired count of yarn. Thus the present invention is in keeping with the recent tendency towards using a large number of spindles per spinning machine.

What is claimed is:

1. A draft roll device for a spinning machine comprising a back bottom roll, means defining an apron bottom roll, and a front bottom roll, all connected at common side ends thereof to a driving source through a first drive transmission system and driven at a predetermined speed ratio between any two of said rolls, said means defining an apron bottom roll comprising a first apron bottom roll section at said common side end thereof and a separate and substantially independently mounted but axially aligned second apron bottom roll section at the other side end thereof; and said back bottom roll, said second apron bottom roll section, and said front bottom roll being operatively connected at their respective other side ends to a second drive transmission system, whereby rotation of said back bottom roll and said front bottom roll is transmitted from said other side end to said second apron bottom roll section.

2. The device as claimed in claim 1, wherein sensing means are provided adjacent to each of said first and second apron bottom roll sections for respectively sensing their rotational angles, said sensors being connected to a control unit adapted for issuing a signal when the difference in the phase of rotation between said first and second sections as sensed by said sensors has exceeded a preset value.

3. The device as claimed in claim 2, wherein said second drive transmission system is connected to load disconnecting means connected to said control unit and adapted to receive said signal, thereby to prevent an overload from being applied to said back and front bottom rolls.

4. The device as claimed in claim 3, wherein said first and second drive transmission systems each comprise change gears to change the speed ratio between said back and front bottom rolls, and change gears to change the speed ratio between said back bottom roll and each of said first and second apron bottom roll sections.

5. The device as claimed in claim 4, wherein said load disconnecting means is provided within a drive transmission path connecting said back bottom roll to said second apron bottom roll section.

6. The device as claimed in claim 1 wherein sensing means are provided adjacent to each of the opposite ends of said front bottom roll for sensing the respective rotational angles of said opposite ends, said sensors being connected to a control unit adapted for issuing a signal when the difference in the phase of rotation between said opposite ends as sensed by said sensors has exceeded a preset value.

7. The device as claimed in claim 1, wherein sensing means are provided adjacent to each of the opposite ends of said back bottom roll for sensing the respective rotational angles of said opposite ends, said sensors being connected to a control unit adapted for issuing a signal when the difference in the phase of rotation between said opposite ends as sensed by said sensors has exceeded a preset value.

* * * * *